US005462376A

United States Patent [19]

Kageyama et al.

[11] Patent Number: 5,462,376

[45] Date of Patent: Oct. 31, 1995

[54] MECHANICAL PENCIL WITH IMPROVED SLIDER MECHANISM

[75] Inventors: Hidehei Kageyama; Shouji Anzai; Yoshihide Mitsuya, Saitama, all of Japan

[73] Assignee: Kotobuki & Co., Ltd., Kyoto, Japan

[21] Appl. No.: 197,477

[22] Filed: Feb. 16, 1994

[51] Int. Cl.[6] ..... B43K 21/22; B43K 21/16

[52] U.S. Cl. ..... 401/65; 401/81

[58] Field of Search ..... 401/53, 65, 80, 401/81

[56] References Cited

U.S. PATENT DOCUMENTS

| | | | |
|---|---|---|---|
| 4,504,163 | 3/1985 | Hashimoto et al. | 401/65 |
| 4,714,365 | 12/1987 | Kageyama et al. | 401/65 |
| 4,884,910 | 12/1989 | Kageyama et al. | 401/65 |
| 4,896,982 | 1/1990 | Kageyama et al. | 401/65 |
| 4,955,739 | 9/1990 | Kageyama et al. | 401/65 |
| 4,957,384 | 9/1990 | Kageyama et al. | 401/65 |

FOREIGN PATENT DOCUMENTS

| | | | |
|---|---|---|---|
| 268398 | 5/1988 | European Pat. Off. | 401/65 |
| 2609671 | 9/1977 | Germany | 401/81 |
| 3910545 | 9/1990 | Germany | 401/65 |

*Primary Examiner*—Steven A. Bratlie

*Attorney, Agent, or Firm*—Rothwell, Figg, Ernst & Kurz

[57] ABSTRACT

A slider mechanism of a mechanical pencil is capable of fixing its lead guide at positions of its projection and withdrawal. The slider mechanism comprises a slider fixing the lead guide, the slider being provided with a sliding member sliding on the internal peripheral surface of a point member, a projection provided on the rear end of the external peripheral surface of the sliding member, and grooves provided on the internal peripheral surface of the point member, the grooves being engaged with the projection at positions of the lead guide's projection from and withdrawal into an aperture on the tip of the point member. The projecting position of the lead guide in a writing state and the withdrawal position in a housing state are securely maintained.

5 Claims, 3 Drawing Sheets

MECHANICAL PENCIL WITH IMPROVED SLIDER MECHANISM

BACKGROUND OF THE INVENTION

1. Field of the Invention

This invention relates to a slider mechanism of a mechanical pencil which can fix a lead guide at positions of its projection and withdrawal.

2. Description of the Prior Art

FIG. 1 is a cross-sectional view showing a prior art slider of a mechanical pencil. In FIG. 1, the slider 20 has a structure in which a lead aperture 21, a sliding member 23 and an elastic body 24 are concentrically configured. A lead guide 12 is fixed at the lead aperture 21, and the lead aperture 21 penetrates through the mechanical pencil along its longitudinal axis direction for passing through a lead 19. The sliding member 23 frictionally slides along the axis direction with an elastic force on the internal peripheral surface 22 of a point member 2. The elastic body 24 holds the lead 19 by elastically engaging it.

The slider 20 moves from the position where the stopper surface 25 of the slider 20 touches the engaging surface 26 of the point member 2 to the position where the rear end of the sliding member 23 touches a lead chuck 4, and the slider 20 brings the lead guide 12 to a projection state and a withdrawal state. The projection state and the withdrawal state of the slider 20 are maintained by means of a small frictional resistance between the sliding member 23 and the internal peripheral surface 22 of the point member 2.

Next, the operation of the prior art slider will be described. When the lead chuck 4 is pushed out through a lead pipe 3 by a knocking operation of a rear end knock portion (not shown) of the mechanical pencil, the chuck fastening ring 7 first stops against the end portion 27 of the point member 2 while the lead chuck 4 continues to move, to thereby unfasten the lead chuck 4 so as to release the lead 19 from the chuck 4, then the front end of the lead chuck 4 touches the slider 20 and pushes it to project the lead guide 12 out by moving the slider 20 to the position where the stopper surface 25 touches the engaging surface 26. After that, if the knocking operation is removed, the lead chuck 4 returns to its original position through the repulsive force of the elastic body 9, and the chuck fastening ring 7 then fastens the lead chuck 4 to fix the lead 19. The lead 19 is sent out from the tip portion of the lead guide 12 by repeating the aforementioned operation. Thus, the lead guide 12 projects from the point member 2 in a slider type mechanical pencil, contrary to a fixed type mechanical pencil (not shown), where the lead guide is always kept in the projection state because the slider portion is constructed together with the point member in the pencil body.

After writing, the lead 19 is in a state in which the lead 19 is fastened by the lead chuck 4. From this state, when the rear end knock portion is knocked while also pushing the tip portion of the lead guide 12 with an appropriate means such as the tip of a finger and the like, the lead 19 is released from the fastening of the lead chuck 4 and it is moved to the right in FIG. 1 by the pushing force, then the lead 19 withdraws into the point member 2 together with the lead guide 12.

Because the prior art slider is configured as remarked above, it has the following problem. That is to say, when the prior art mechanical pencil is used with a ruler, the lead guide 12 often withdraws by itself if it contacts the ruler, and the lead 19 is left exposed. That is to say, the lead 19 is left in a projection state, and it will be easily broken.

The aforementioned fixed type mechanical pencil, namely the popular and ordinary mechanical pencil whose lead guide 12 is fixed to the point member 2, has such a problem that the tip of the always projecting lead guide 12, even if the pencil is not used, will often injure clothes or persons.

SUMMARY OF THE INVENTION

In view of the foregoing, it is an object of the present invention to provide a slider mechanism of a mechanical pencil which solves the aforementioned problems of both the slider type and the fixed type mechanical pencils, concerning the lead guide 12, by providing a slider capable of keeping the lead guide 12 in both the projection state and the withdrawal state.

According to the present invention, for achieving the above-mentioned object, there is provided a slider mechanism of a mechanical pencil comprising a slider fixing a lead guide and a point member equipped with an aperture, wherein the slider is equipped with a sliding member sliding in the internal peripheral surface of the point member and a projection formed on the external peripheral surface of the rear end portion of the sliding member, and the internal peripheral surface of the aforementioned point member is equipped with grooves for engaging the aforementioned projection at the projection position and the withdrawal position of the aforementioned lead guide from the aperture of the point member.

As stated above, the slider mechanism of the mechanical pencil according to the present invention is provided with a lead guide which is engaged at the projection position and the withdrawal position, the lead guide being fixed at the projection position for writing and being kept at the withdrawal position when not in use.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

Preferred embodiments of the invention will now be described in detail on reference to the accompanying drawings.

Figure 1:
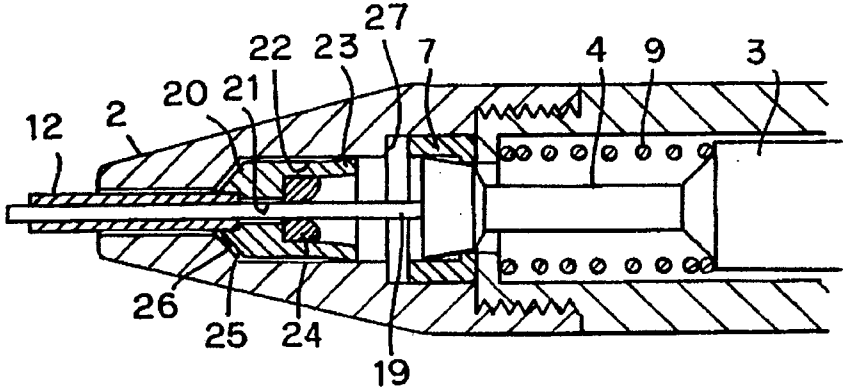
FIG.1 (PRIOR ART)
FIG. 1 is a cross-sectional view showing the point-side configuration of a prior art mechanical pencil.
Figure 2:
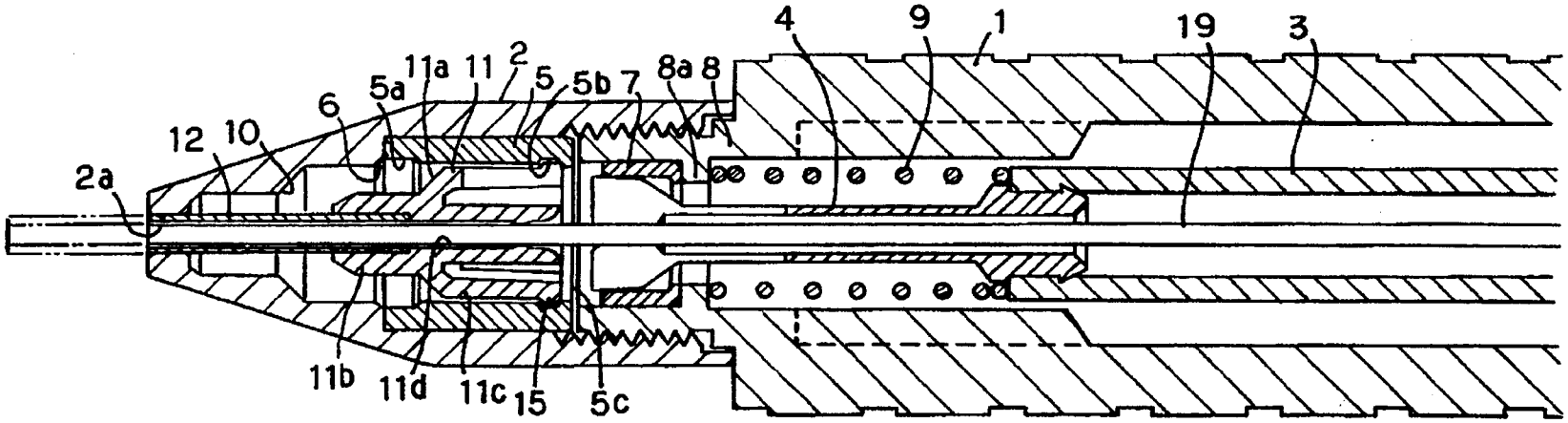
FIG. 2 is a cross-sectional view showing the point-side configuration of a mechanical pencil of an embodiment of the present invention.
Figure 3:
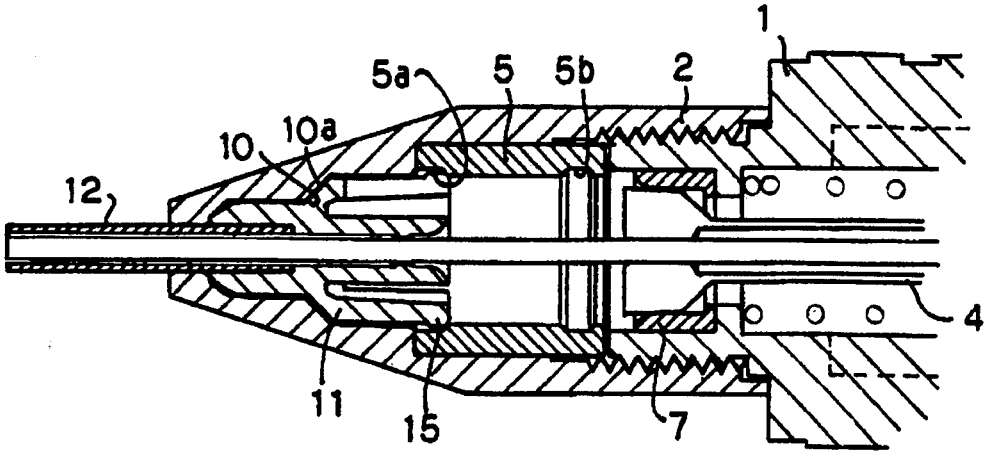
FIG. 3 is a cross-sectional view for explaining the operation state of the embodiment of FIG. 1.
Figure 4:
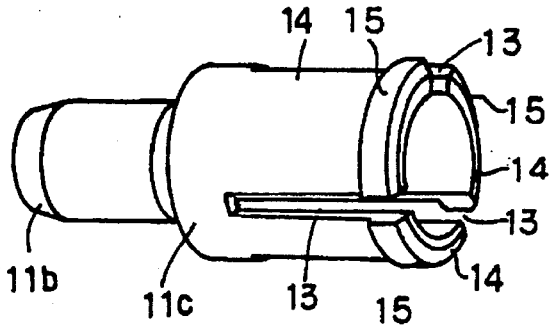
FIG. 4 is a perspective view of the slider of FIG. 1.
Figure 5:
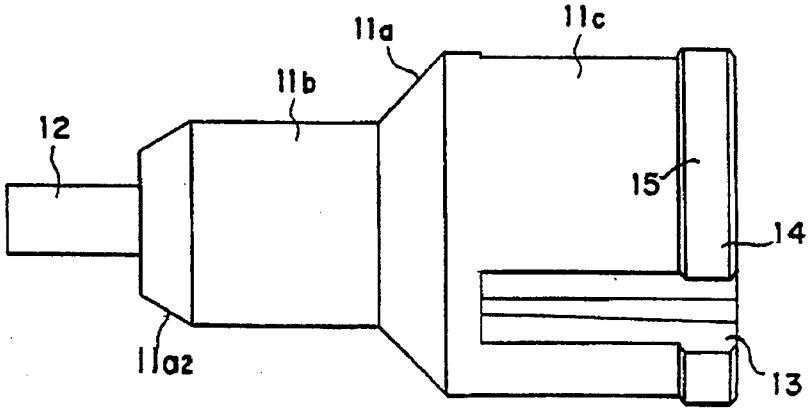
FIG. 5 is an elevational view of the slider of FIG. 4.
Figure 6:
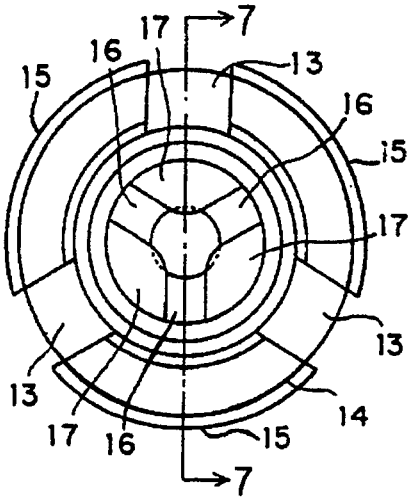
FIG. 6 is a side elevation view of the slider of FIG. 4.

FIG. 2 and FIG. 3 are expanded cross-sectional views of primary parts of an embodiment of the invention. In FIGS. 2 and 3, reference numeral 1 designates an outer tube capable of being held by a hand, and the point member 2 is screwed on the outer tube 1. The lead pipe 3 is coaxially inserted in the outer tube 1, and the lead chuck 4 is connected to the tip of the lead pipe 3. On the rear end portion of the lead pipe 3 is detachably fitted a receiving member (not shown), and in the receiving member is housed an eraser (not shown). The tip portion of the lead chuck 4 penetrates through the center of the chuck fastening ring 7, and the rear end of the chuck fastening ring 7 is opposed to a flange portion 8a formed together with the outer tube 1 of the body.

Moreover, the elastic body 9 which biases the lead pipe 3 rearward for fastening the chuck 4 is interposed between the front end of the lead pipe 3 and the flange portion 8*a*.

The point member 2 is conically tapered toward the end portion thereof, and at the internal peripheral surface of the end portion is formed an engaging surface 10 in the form of an included stepped portion with a varying inside diameter. And inside the end portion of the point member 2 is housed a slider 11, having a stopper surface 11*a*, which is axially slidable but restricted in forward displacement by the engaging surface 10.

This slider 11 is integrally molded of a synthetic resin such as ABS resin or polyacetal into a tubular configuration as a whole.

Figure 7:
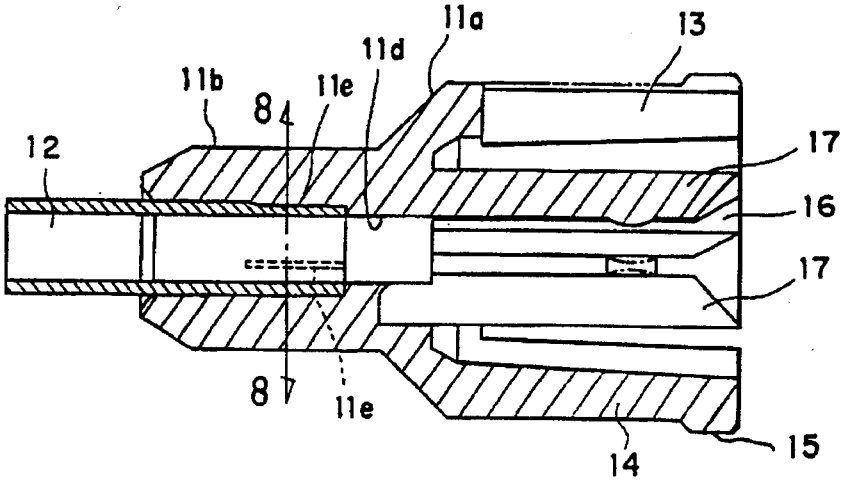
FIG. 7 is a cross-sectional view taken on line A—A of FIG. 6.

This slider 11 is integrally comprised of two tubular members which are different in diameter as shown in FIGS. 4, 5, 6 and 7. More specifically, reference number 11*b* designates a small diameter portion, and number 11*c* designates a large diameter portion. The lead guide 12 is fitted under pressure and the like into the central aperture of the small diameter portion 11*b* to allow a lead to pass therethrough as will be described hereinafter. Also, a penetrating aperture 11*d* for allowing the lead to pass therethrough is provided inside a thick wall portion in the vicinity of a central portion connecting the small diameter portion 11*b* with the large diameter portion 11*c*. The large diameter portion 11*c* is in the form of a double tube, on an outer tube portion of which are axially formed three cuts 13 at equidistant intervals to thereby form three sliding members 14 having repulsive force. Moreover, projections (slider engaging portions) 15 are provided on the outer peripheral portions of the rear ends of each of these sliding members 14 having the cuts 13. Also, each of these sliding members 14, as shown in FIG. 7, is formed to become gradually thinner in wall thickness toward the free ends thereof. Consequently, because the portions of each sliding member 14 near the aforementioned projections 15 have the thinnest wall thickness, the sliding members 14 obtain more effective elasticity.

On the other hand, on the internal peripheral surface of the point member 2 is fitted a cylindrical member 5 having grooves (engaging portions) 5*a* and 5*b* on both end portions thereof with which the projections 15 on the sliding members 14 are engaged when the slider 11 axially slides.

Moreover, three cuts 16 are formed on the inner tubular portion of the slider 11 thereby three touching members 17 having weak repulsive force are formed. And a lead is weakly held inside these touching members 17.

Figure 8:
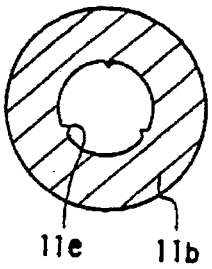
FIG. 8 is a cross-sectional view taken on line B—B of FIG. 7.

Besides, reference numeral 11*e* shown in FIG. 7 and FIG. 8 designates a rib performing a function to make surer fitting possible in case of inserting the lead guide 12 into the small diameter portion 11b with pressure.

Also, the number of sliding members 14 on the outer tubular portion of the large diameter portion 11c of the slider 11 and the number of touching members 17 on the inner tubular portion thereof are not limited to the numbers of the aforementioned embodiment, but the numbers may be only one or an arbitrary plural number.

Next, the operation of this apparatus according to the embodiment will be described.

Now, in the state where a forward external force is not exerted on the rear portion of the lead pipe 3, the lead chuck 4 biased to the backward direction is moved back relative to the chuck fastening ring 7, therefore the front end portion of the lead chuck 4 fastens the lead 19. In the state shown in FIG. 2, when a force is exerted upon the lead pipe 3 from the rear end side of the pencil body through a knocking operation, the lead chuck 4 likewise moves forward together with the chuck fastening ring 7, and when the ring 7 abuts against the step portion 5*c* of the cylindrical member 5, only the lead chuck 4 advances leaving the ring 7 against the portion 5*c*, to thereby release the fastening of the lead 19. And further, the lead chuck 4 engages the slider 11 to push it, then the chuck 4 disengages the engagement of the projections 15 with the grooves 5*b*. Furthermore, the chuck 4 advances to the position where the stopper surface 11a of the slider 11 contacts the engaging surface 10 of the point member 2 to engage the projections 15 with the grooves 5*a*. Hereby, the lead guide 12 is fixed at the projection position of the state capable of use for writing. Thus, since the lead guide 12 is fixed, the guide 12 does not withdraw even if it touches a ruler upon writing.

Next, when the aforementioned external force is released, the lead pipe 3 makes a backward movement together with the lead chuck 4 while holding the lead inside the lead guide 12. The chuck fastening ring 7 touches the flange portion 8*a* to fasten the front end of the lead chuck 4 to the lead 19 at this place. Then, the lead pipe 3 stops its backward movement while holding the lead 19.

Thus, after the slider 11 is fixed at the advanced position, the mechanical pencil takes the state to be used in writing with the lead 19 projected from the lead guide 12 enough to write by repeating the aforementioned knocking operation. As the lead 19 is consumed, it is sent out successively by repeating the knocking operation. The length of the lead 19 sent out by one knocking operation is almost equal to the length from the front end of the chuck fastening ring 7 to the step portion 5*c*.

When the lead guide 12 is withdrawn into the point member 2 after writing, the engagement of the projections 15 with the groove 5*a* is disengaged by knocking the rear knock end while the tip of the lead guide 12 is pressed on a paper face and the like. The projections 15 are pushed into the position where they engage with the groove 5*b* to withdraw in the point member 2, then the projections 15 are fixed at that position. Thus, the lead guide 12 can be fixed in the withdrawal state when not is use. Moreover, since the lead chuck 4 unfastens the lead 19 when in the knocking state, in case of the operation of the withdrawal the lead 19 is pushed into the point member 2 together with the slider 11 to be kept at the same position as that of the tip of the lead guide 12. Consequently, the lead 19 is kept in the withdrawal state together with the lead guide 12. In the embodiment mentioned above, the grooves 5*a*, 5*b* engaging with the projections 15 of the slider 11 are provided on the cylindrical member 5 fitted in the point member 2 so that the configuration of the embodiment is easy to assemble and to disassemble the slider 11, but it may be applicable to directly insert the slider 11 in a state slidable inside the internal peripheral surface of the point member 2 and to form the aforementioned grooves 5a, 5b on the sliding surface of the point member 2.

It will be appreciated from the foregoing description that, according to the invention, the slider mechanism of the mechanical pencil is provided with projections formed on a sliding member of the slider, and grooves formed on the internal peripheral surface of a point member so as to engage with the projections at the positions projecting and withdrawing a lead guide respectively on the slider's axial sliding, and consequently, the lead guide is surely held at the projection position in a writing state and the withdrawal position in a housing state. Therefore, the slider mechanism of the mechanical pencil of the invention has such effects that there is no accident of breaking a lead owing to the projection of the lead alone by the unintended withdrawal of the lead guide which often happened in the prior art slider type mechanical pencil by the lead guide's touching with something such as a ruler, furthermore that there is also no injury to clothes or persons owing to the projection of the lead guide which is often caused by a prior art fixed type mechanical pencil, since the lead guide is withdrawn on being carried.

While preferred embodiments of the invention have been described using specific terms, such description is for illustrative purposes only, and it is to be understood that changes and variations may be made without departing from the spirit or scope of the following claims.

What is claimed is:

1. A mechanical pencil, comprising:

an outer tube;

a point member attached to said outer tube;

an axially slidable lead guide inserted in said point member;

a slider fixed to said lead guide for sliding said lead guide along an axis of said point member between a fully projected position for writing and a fully retracted position for storage;

said slider including an inner tubular member for frictionally supporting a movable lead with a first frictional resistance allowing said lead to move within said lead guide, a sliding member for contacting an internal peripheral surface of said point member with a second frictional resistance greater than said first frictional resistance, and a locking projection provided on an external peripheral surface of said sliding member for securing said slider at one of only two predetermined positions within said point member; and wherein an internal recessed peripheral engaging surface is provided on said internal peripheral surface of said point member for engaging the locking projection of said slider at either of said only two predetermined positions which correspond to said fully projected position and said fully retracted position of said lead guide.

2. A mechanical pencil according to claim 1, wherein said inner tubular member comprises a plurality of elongated touching members formed in the inner tubular member of said slider which contact said movable lead with said first frictional resistance.

3. A mechanical pencil according to claim 1, wherein said slider comprises a plurality of locking projections formed on said sliding member and said internal recessed peripheral engaging surface comprises a first recessed groove for engaging at least one of said locking projections at said projected position of the lead guide, and a second recessed groove for engaging at least one of said locking projections at said retracted position of the lead guide.

4. A mechanical pencil according to claim 1, wherein said sliding member comprises a plurality of sliding members formed in an outer tubular member of said slider which is coaxial with said inner tubular member of said slider, and the plurality of sliding members contact said inner peripheral surface of said point member with said second frictional resistance.

5. A mechanical pencil according to claim 4, wherein each of a plurality of locking projections are formed on a respective one of said plurality of sliding members, and said internal recessed peripheral engaging surface comprises a plurality of first recessed grooves for engaging with said locking projections at said projected position of said lead guide and a plurality of second recessed grooves for engaging with said locking projections at said retracted position of said lead guide.

* * * * *